US006213301B1

(12) United States Patent
Landis et al.

(10) Patent No.: US 6,213,301 B1
(45) Date of Patent: Apr. 10, 2001

(54) PLASTIC CONTAINER FOR FOOD PRODUCTS

(75) Inventors: Henry J. Landis, Orland Park, IL (US); Donald P. Messer, Eden Prairie, MN (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 09/119,072

(22) Filed: Jul. 10, 1998

Related U.S. Application Data

(63) Continuation-in-part of application No. 08/975,149, filed on Nov. 20, 1997.

(51) Int. Cl.[7] ..... B65D 41/00; B65D 85/62

(52) U.S. Cl. ..... 206/519; 220/359.1; 220/613; 220/623; 426/106

(58) Field of Search ..... 220/359.1, 359.2, 220/359.4, 613, 659, 792, 380, 623; 206/508, 519, 520, 217; 215/324, 247, 232, 349, 45, 44; 428/542.8; 426/106

(56) References Cited

U.S. PATENT DOCUMENTS

| | | |
|---|---|---|
| Re. 31,912 | 6/1985 | Fortuna et al. . |
| D. 252,796 | 9/1979 | Fortuna et al. . |
| D. 254,293 | 2/1980 | Fortuna et al. . |
| D. 270,813 | 10/1983 | Fortuna . |
| D. 271,665 | 12/1983 | Fortuna et al. . |
| D. 272,320 | 1/1984 | Fortuna . |
| D. 274,217 | 6/1984 | Aramaki . |
| D. 281,303 | 11/1985 | Fortuna . |
| D. 281,399 | 11/1985 | Fortuna . |
| D. 283,595 | 4/1986 | Fortuna et al. . |
| D. 283,596 | 4/1986 | Fortuna et al. . |
| D. 283,677 | 5/1986 | Fortuna et al. . |
| D. 283,678 | 5/1986 | Fortuna et al. . |
| D. 283,791 | 5/1986 | Fortunal et al. . |

(List continued on next page.)

FOREIGN PATENT DOCUMENTS

| | | | |
|---|---|---|---|
| 1904088 | * 8/1968 | (DE) | 206/520 |
| 0159051 | 10/1985 | (EP) . | |
| 1252434 | * 11/1971 | (GB) . | |
| 2156265 | 10/1985 | (GB) . | |
| 2156268 | 10/1985 | (GB) . | |
| 2163124 | 2/1986 | (GB) . | |
| 2252093 | 7/1992 | (GB) . | |

*Primary Examiner*—Allan N. Shoap
*Assistant Examiner*—Joe Merek
(74) *Attorney, Agent, or Firm*—John A. O'Toole; Alan D. Kamrath; Everett G. Diederiks

(57) ABSTRACT

A two part plastic container for food products is provided having a main body and a base for being attached to the bottom of the body. The body has a frustoconical sidewall with a radial bottom rim and the base has a shorter frustoconical sidewall with a radial bottom rim. The rims are advantageous in that they allow stacks of the container bodies and bases to be processed with container feeding equipment presently in use as the rims provide distinct structure for being fed by the mechanical devices of the equipment. An energy director area is provided between the rims for ultrasonically attaching the container body and base. The container body has a smooth sidewall over substantially its entire extent without indentations or bumps for maximizing the printing area thereon. Both the container body and base minimize the size of their respective nest intervals when stacked to conserve space for shipping and processing purposes while still allowing for easy denesting with parts readily separated from the stack due to the provision of the rims. In a preferred form, the inner edges of the stacking shoulders of the bases are outwardly tapered for self-centering when stacked. The lip of the body defining the mouth of the container includes inner and outer annular portions, with the inner annular portion extending upwardly relative to the outer annular portion and terminating in a wedge shape for enhanced sealing.

20 Claims, 6 Drawing Sheets

U.S. PATENT DOCUMENTS

| | | | | |
|---|---|---|---|---|
| D. 283,793 | | 5/1986 | Fortuna et al. . | |
| D. 284,350 | | 6/1986 | Fortuna et al. . | |
| D. 284,940 | | 8/1986 | Fortuna et al. . | |
| D. 285,530 | | 9/1986 | MacLaughlin . | |
| D. 285,531 | | 9/1986 | Peterson et al. . | |
| D. 285,532 | | 9/1986 | MacLaughlin . | |
| D. 285,536 | | 9/1986 | MacLaughlin . | |
| D. 285,653 | | 9/1986 | Fortuna et al. . | |
| D. 285,654 | | 9/1986 | MacLaughlin . | |
| D. 285,655 | | 9/1986 | MacLaughlin et al. . | |
| D. 285,774 | | 9/1986 | MacLaughlin . | |
| D. 285,775 | | 9/1986 | MacLaughlin . | |
| D. 291,060 | | 7/1987 | MacLaughlin . | |
| D. 291,062 | | 7/1987 | MacLaughlin . | |
| D. 369,971 | * | 5/1996 | Brauner | D9/428 |
| 3,039,646 | | 6/1962 | Merz . | |
| 3,204,799 | * | 9/1965 | Hunter et al. | 215/45 |
| 3,273,746 | * | 9/1966 | Andrews, Jr. | 220/698 |
| 3,403,804 | * | 10/1968 | Colombo | 215/45 |
| 3,441,173 | * | 4/1969 | Edwards | 206/520 |
| 3,478,913 | | 11/1969 | Kemp . | |
| 3,499,567 | | 3/1970 | Spotts . | |
| 3,666,088 | * | 5/1972 | Wingardh | 206/508 |
| 3,739,939 | * | 6/1973 | Koenig | 206/520 X |
| 3,788,509 | * | 1/1974 | Keeler | 215/324 |
| 4,049,122 | * | 9/1977 | Maxwell | 206/519 |
| 4,096,947 | * | 6/1978 | Morse | 206/519 |
| 4,193,494 | * | 3/1980 | Green | 206/217 |
| 4,326,567 | | 4/1982 | Miatarz . | |
| 4,386,999 | | 6/1983 | Fortuna et al. . | |
| 4,420,081 | * | 12/1983 | Dart | 206/520 |
| 4,496,066 | | 1/1985 | Bullock, III . | |
| 4,514,242 | | 4/1985 | MacLaughlin et al. . | |
| 4,515,651 | | 5/1985 | MacLaughlin et al. . | |
| 4,556,445 | | 12/1985 | McCormick . | |
| 4,560,064 | | 12/1985 | Peterson et al. . | |
| 4,572,851 | | 2/1986 | Fortuna . | |
| 4,575,987 | | 3/1986 | Fortuna . | |
| 4,583,656 | | 4/1986 | MacLaughlin . | |
| 4,584,037 | | 4/1986 | Fortuna et al. . | |
| 4,610,351 | * | 9/1986 | Coles | 206/217 |
| 4,613,746 | | 9/1986 | MacLaughlin . | |
| 4,618,516 | * | 10/1986 | Sager | 428/542.8 |
| 4,636,349 | | 1/1987 | MacLaughlin . | |
| 4,826,039 | | 5/1989 | Landis . | |
| 4,854,472 | * | 8/1989 | Semersky | 220/783 |
| 4,872,586 | | 10/1989 | Landis . | |
| 5,176,284 | * | 1/1993 | Sorensen | 220/659 |
| 5,180,599 | * | 1/1993 | Feldmeier et al. | 426/106 |
| 5,263,606 | * | 11/1993 | Dutt et al. | 220/613 |
| 5,377,861 | * | 1/1995 | Landis | 220/380 |
| 5,489,036 | * | 2/1996 | Arkins | 215/45 X |
| 5,992,629 | * | 11/1999 | Gullord et al. | 206/457 |

* cited by examiner-

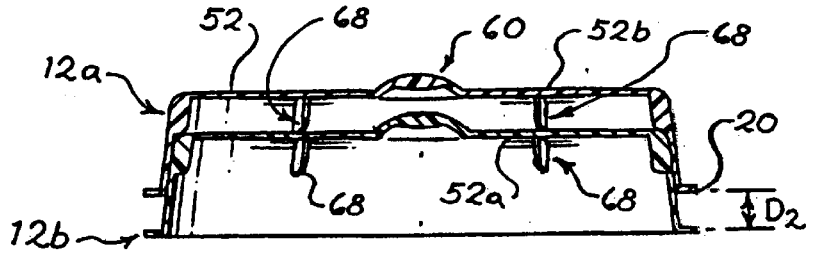
Fig. 12
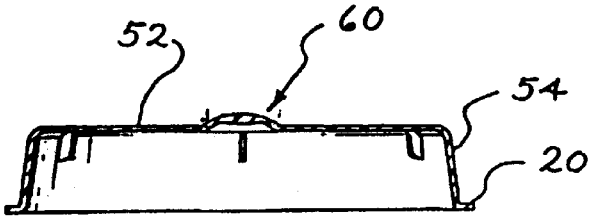
Fig. 7
Fig. 5
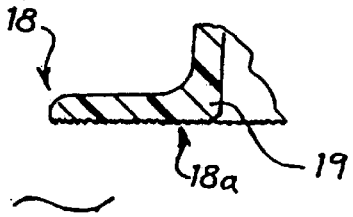
Fig. 3
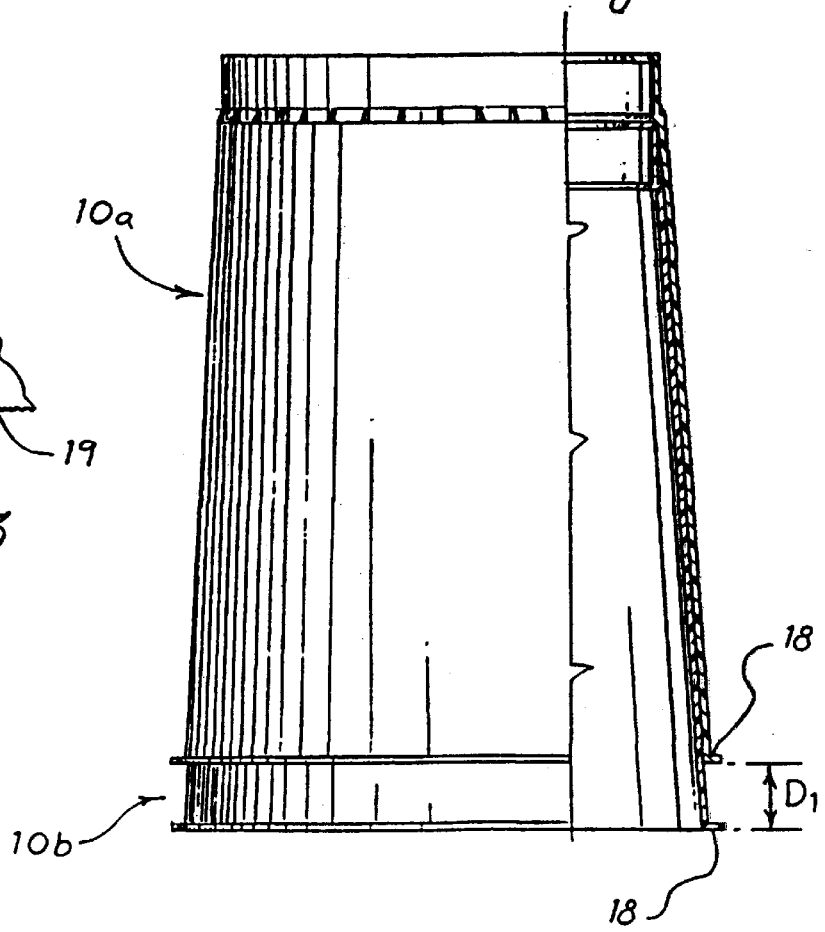

Fig. 8
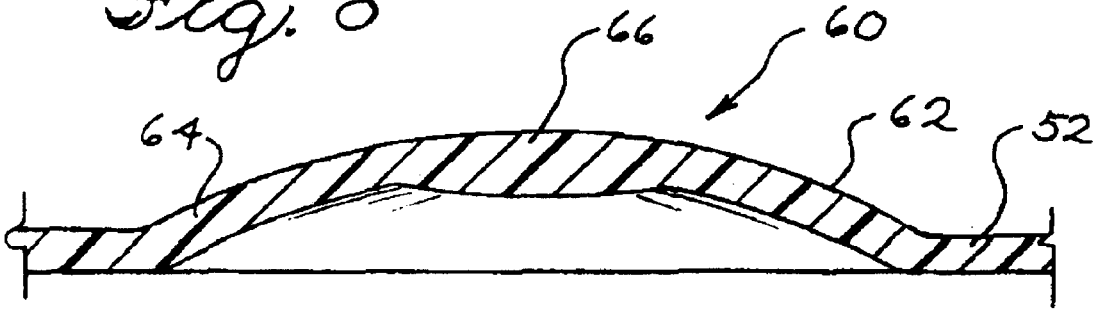
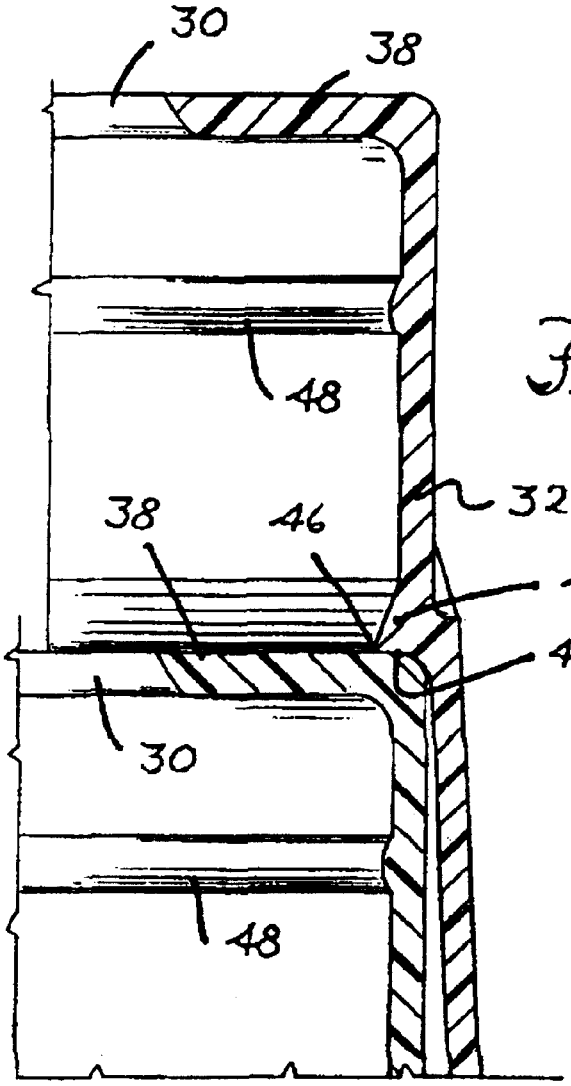
Fig. 13

PLASTIC CONTAINER FOR FOOD PRODUCTS

CROSS REFERENCE

This is a continuation-in-part of U.S. application Ser. No. 08/975,149 filed Nov. 20, 1997.

FIELD OF THE INVENTION

The invention relates to plastic containers, and more particularly, to injection-molded containers for containing food products.

BACKGROUND OF THE INVENTION

One area where the use of plastic containers has become widespread is in the food packaging industry. Accordingly, it is common for these plastic food containers to serve as the end display package in which the product is presented for sale to the customer. Typical of these containers are those used for dairy products such as cottage cheese, sour cream, or the like where an integral body of the container is provided having a sidewall that tapers down to an integral transverse bottom wall with the top opening being closed by a plug fit lid. Normally, the lid has a depending peripheral skirt which locks onto the upper rim of the tapered wall of the container body. One difficulty encountered in the design of closure lids for the containers described above is ensuring that when they are nested in a stack such as for shipping, the stacked lids maintain a constant gap between adjacent skirts of respective stacked lids. Maintaining uniform gap spacing is important to allow them to be efficiently utilized with high-speed automated packaging equipment which position the containers for automatic filling and automatically caps the filled containers with lids taken from the stack by mechanical devices of the equipment. Various rib structures have been employed with lids to provide the requisite spacing, see e.g. U.S. Pat. Nos. 4,826,039 and 5,377,861.

Many of these food product plastic containers have their parts formed by a thermoforming process. In thermoforming, a thin plastic sheet is formed into the desired shape by heating and forcing the sheet against a mold to produce a container part having a uniform, very thin, cross-sectional thickness which can result in a part having very flexible walls. In the particular application of interest herein, currently there is a flavored yogurt thermoformed container that has a reverse tapered sidewall with a larger diameter bottom and being open at both the smaller diameter top and at the bottom thereof. A separate bottom closure member is also formed by thermoforming and is spinwelded to the sidewalls to close off the bottom for receiving yogurt therein. The bottom closure includes a base panel and depending skirt wall which is spinwelded to the interior surface of the body wall to permanently attach the pieces together. Thus, unlike the previously described top closure lids which are designed to be opened, the bottom closure for this particular yogurt container does not have a locking skirt which locks onto a rim of the sidewall and which can be opened to gain access to the food therein. Instead, after being filled with yogurt, the top is closed by a flexible foil seal as by an adhesive. To gain access to the yogurt, the seal is peeled open from over the opening at the top of the container sidewall.

The thermoformed and spinwelded yogurt containers described above suffer from numerous shortcomings. For spinwelding the bottom closure to the container body wall, both pieces are provided with integral gripping lugs which project relatively far radially inward relative to the body and skirt walls so that they can be grasped by the spinwelding equipment for rotating the two parts relative to each other to create frictional heating for welding the parts together. The bottom closure has the lugs formed on its skirt, and the body sidewall has lugs around the top thereof. The spinwelding technique requires specialized handling and filling equipment that results in a relatively slow production of containers for filling.

Since the parts of the above-described yogurt container are thermoformed parts having a constant wall thickness, the radially inward projecting lugs form corresponding indentations on their exterior wall surfaces. Because of the aforementioned display function of the exterior surface of the yogurt container, maximizing the amount of surface area available for printing information, such as product characteristics, e.g. ingredients, nutritional content, or other required information about the product, is an important consideration, especially where the containers are relatively small, such as for example with the preferred 6 oz. (170 g) yogurt containers herein. The lugs at the top of the wall restrict the height of the printing that can be received on the container sidewall. In addition, there are unsightly indentations on the sidewall due to the lugs that are readily visible to the purchaser, and because of the radial extent to which they project into the container interior, they can unduly interfere with removing the food product therefrom, e.g. spooning yogurt out from the container. Accordingly, there is a need for a plastic container for food products such as a yogurt container which is more aesthetically pleasing, and better maximizes the print receiving surface area thereon.

Another significant characteristic the containers should possess is the ability to stack with uniform spacing between the container parts and so that while stacked, adjacent parts do not become jammed and wedged together. In addition, the space taken up by a given number of stacked container parts should be minimized. The above described lugs of the prior yogurt container, in addition to their grasping function for spinwelding provide a stacking surface with their bottom flat surfaces. The indentations of the lugs extend relatively far down the sidewalls spaced from the top in both the container body and the bottom closure. This precludes stacking of these container parts in a compact fashion.

It is also important that the container be adapted to be used with conventional automated container feeding equipment that is currently employed in container filling assembly and printing operations. Both the upper container wall and the bottom closure lack an annular rim for feeding with mechanical mechanisms or devices such as mechanical fingers, feed screws or shuttles of the automated feeding equipment commonly used with the packaging of dairy products.

As previously mentioned, thermoformed plastic containers generally have very thin cross-sectional thickness so that their walls can be very flexible. This is especially true with the bottom closure of the above described yogurt container where the skirt sidewall is relatively thin in thickness and the base panel is quite wide in diameter which can cause the closure member to be very pliable.

SUMMARY OF THE INVENTION

In accordance with the present invention, an improved, injection-molded plastic container is formed with an upper main body portion ultrasonically welded to a lower body portion. Preferably, each of the body portions has a small annular rim that is abutted and welded together to form the container. The annular rims allow use of conventional, automatic, container feeding apparatus having mechanical devices for insertion between nested rims in a stack of container portions. Thus, an improved, automated process of forming the container and filling the same can be obtained with this new injection-molded container.

The upper body portion and lower base portion of the container herein are ultrasonically connected together with there being an energy director area between the upper and lower container portions for facilitating the ultrasonic welding process. In the preferred form, the energy director area is provided between the rims of the container body and base. As the container herein avoids spinwelding the parts together such as in the previously described yogurt container, there is no need to provide lugs for grasping the container parts for relative rotation thus eliminating the large indentations that can be seen on the outer surface of the corresponding body portion of the prior yogurt container. Accordingly, the present container has an exterior surface portion of the frustoconical wall of the container body that is smooth over substantially its entire extent extending substantially between the top and bottom of the frustoconical wall so as to provide a large uninterrupted smooth area on the body wall to receive printing thereon. Thus, the container herein maximizes its surface area for receiving print in contrast to the prior spinwelded container having indentations formed by the gripping lugs over which printing cannot be applied.

The base wall of the lower container portion may be provided with a substantially centrally located raised portion that is disposed in the container interior when the upper and lower container portions are ultrasonically attached. The raised portion has inclined surfaces relative to the base wall for distributing loads about the center of the base panel to provide added container strength for meeting the drop test requirements for the container.

Because each of the container portions is injection molded, it may have thick cross-sectional areas where needed to add strength to the overall container to meet drop tests. The thermoformed containers cannot add thickened cross-sectional areas because the container is formed from a sheet of uniform cross-sectional thickness.

Stacking shoulders disposed adjacent the tops of the upper and lower container portions are preferably provided so as to minimize the distance between the tops of the container portions and their respective stacking shoulders for providing stacking of upper container portions on each other and lower container portions on each other in a compact, vertical arrangement. Accordingly, an increased number of container portions can be stacked in a given space versus the prior spinwelded containers which have stacking surfaces on the bottom of the spinwelding lugs that are further down from the top of the corresponding container portion sidewalls. In contrast to the prior container, the present stacking shoulders are closely adjacent the tops of the container portions to minimize the nest interval between stacked parts for more compact stacking. The present container body and base can have a smaller nest interval over that of corresponding parts of the prior container without causing a problem in separating parts from the stack with the container feeding equipment due to the provision of the rims that are lacking in the prior spinwelded container and which can be readily engaged by the equipment's mechanical devices for separation. In addition, with respect to the open-ended container body, there is less of a concern with developing a vacuum type seal between closely stacked parts having tapered walls that would make it more difficult to properly separate the stacked container bodies in a stack with small nest intervals.

In a preferred form, the stacking shoulders of the lower container portions have inner edges which outwardly taper in a downward direction for camming with the top of the frustoconical sidewall for self-centering the lower container portions in a stacked, vertical arrangement.

The lip projecting radially inward from the top of the container sidewall includes an inner annular portion terminating in a free edge and an outer face forming a wedge shape, with the outer face of the inner portion extending upwardly at a small acute angle to the outer face of an outer annular portion. Enhanced sealing is provided between the lip and the thin seal member and eliminating the requirement of gripping on an outwardly projecting roll rim over which the seal member must be crimped to provide sealing attachment.

BRIEF DESCRIPTION OF THE DRAWINGS

FIG. 3 is an enlarged sectional view of the rim of the container main body showing the rough surface at the bottom thereof for ultrasonically welding with a corresponding rim of a lower base portion of the container;

FIG. 5 is an elevational view partially in section showing two container body portions stacked one on top of the other in a compact, vertical arrangement;

FIG. 7 is a cross-sectional view taken along line 7—7 of FIG. 6;

FIG. 8 is an enlarged sectional view of a raised dome provided on the container base portion;

FIG. 12 is a sectional view showing two container base portions stacked one on top of the other in a compact, vertical arrangement;

FIG. 13 is a fragmentary, cross-sectional view showing two container bodies stacked together;

DETAILED DESCRIPTION OF THE PREFERRED EMBODIMENTS

Figure 6:
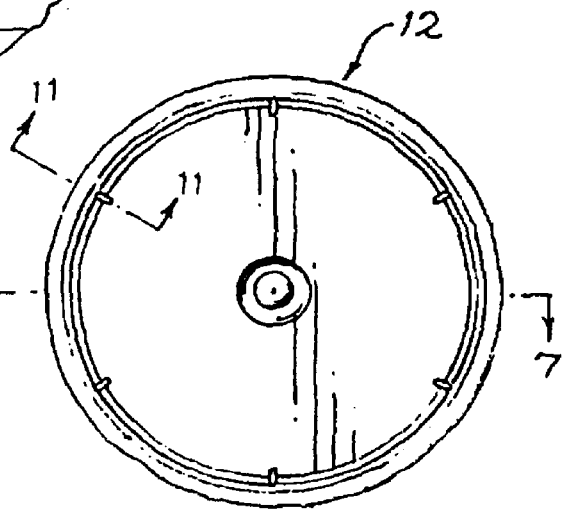
FIG. 6 is a bottom plan view of the container lower base portion having inner stacking ribs formed therearound.
Figure 11:
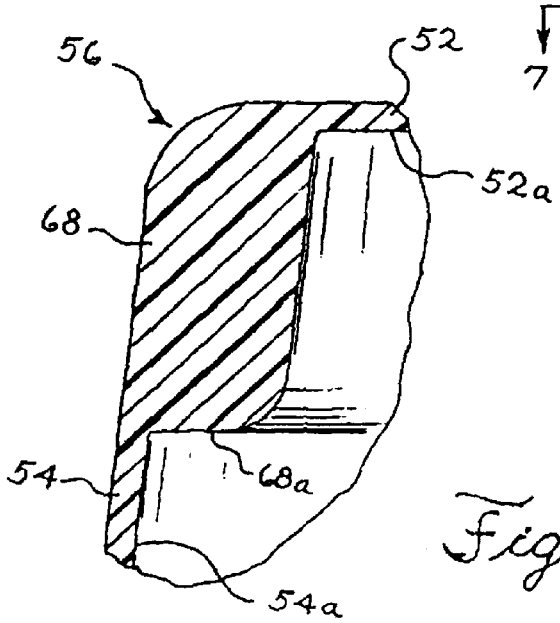
FIG. 11 is an enlarged sectional view taken along line 11—11 of FIG. 6.

The container described herein is a two-part container having an upper main body portion 10 (FIG. 1) and a lower base portion 12 (FIG. 6) which is to be attached at the bottom of the main body portion 10 so as to form an open top container for being filled with food products. The preferred application is as a container for yogurt and the exemplary dimensions set forth herein for the container portions 10 and 12 are for a container that is filled with 6 oz. (170 g) of flavored yogurt; however, it will be understood that size of the container portions and the dimensions can be varied from that described herein and still fall within the scope of the present invention. After being filled, the open top is then sealed by a thin seal member 14 which can be adhered to the top of the main body portion 10 for sealing the food product in the interior 16 of the container.

One important advantage conferred by the upper and lower portions 10 and 12 of the present container is that they are stackable in a very compact and stable manner so as to conserve space during transport of large volumes of these container portions and to enable them to cooperate with presently available automated container feeding equipment that is currently being used with plastic food containers for processing thereof. Both the container body 10 and base 12 are provided with lower annular flanges or rims 18 and 20, respectfully, which project radially outward from the bottom of the respective container portions. As can be seen by reference to FIGS. 5 and 12, the respective rims 18 and 20 provide distinct structure on the container body portions 10 and 12 for readily allowing mechanical devices (not shown) of the feeding equipment to fit between adjacent rims in the stack for separating the container body portions in the stack for further processing. In addition, the rims 18 and 20 can include an energy director area therebetween to facilitate ultrasonic bonding of the rims 18 and 20 together to attach the container base 12 to the container body 10, as will be more fully described hereinafter.

A significant advantage in using an ultrasonic bonding between the upper and lower container portions is that of speed of operation and the elimination of specialized spinning equipment to spin one piece relative to the other piece.

Another significant advantage of providing the ultrasonic bonded rims 18 and 20 over the spinwelding process used to attach the prior yogurt containers is that the exterior surface 22 of the container body 10 can be smooth over substantially its entire extent providing a large uninterrupted, smooth area for receiving printing thereon. This is in direct contrast to the prior spinwelded container which, as previously described, has spinwelding is lugs formed around the top of the corresponding container body for being grasped by the spinwelding equipment. The lugs create large indentations in the container surface which limit the height of printing on the container exterior surface and thus do not maximize the surface area for printing as with the present ultrasonically welded container.

Figure 2:
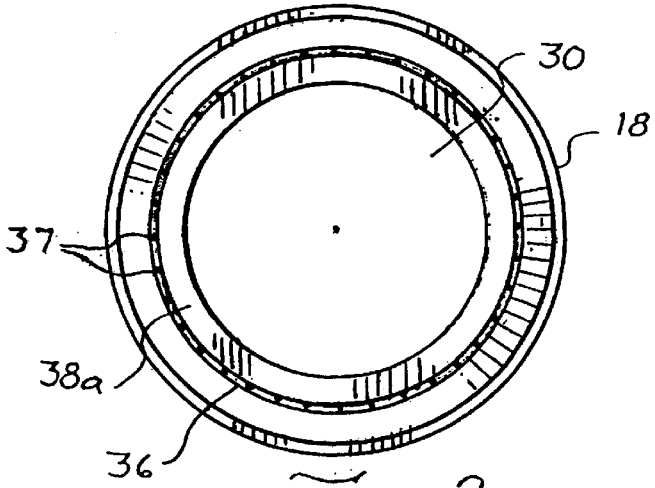
FIG. 2 is a plan view of the container body of FIG. 1.
Figure 10:
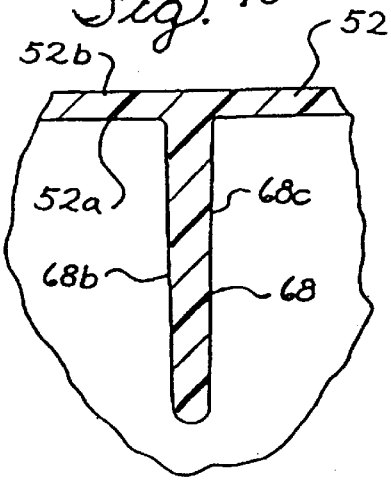
FIG. 10 is an enlarged sectional view of one of the stacking ribs of the container base portion.
Figure 1:
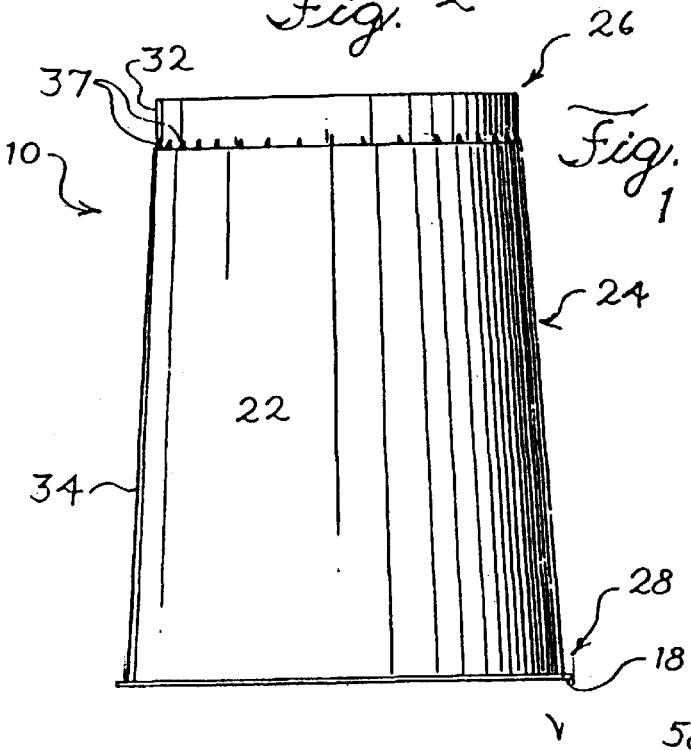
FIG. 1 is an elevational view of an upstanding main body portion of a plastic container for containing food products in accordance with the present invention showing a frustoconical wall of the container body having a larger diameter at its bottom and a radially outward projecting annular rim thereat.

The details of the illustrated and preferred embodiment of the container portions 10 and 12 will next be more specifically described. Referring to FIG. 1, the container body 10 has a sidewall 24 which has a generally frustoconical shape so that it tapers from a smaller diameter top 26 to a larger diameter bottom 28 at which the annular rim 18 is formed and projects radially outward therefrom. As previously mentioned, the bottom 28 is closed off by the container base 12 which is ultrasonically welded thereon leaving a mouth 30 at the sidewall top 26 open for being filled with the food product into the container interior 16.

Figure 4:
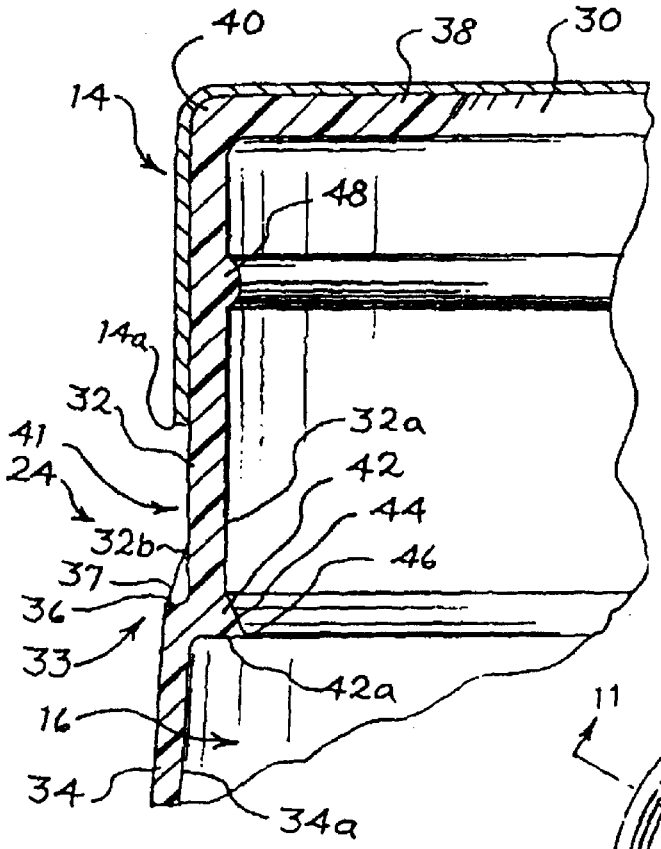
FIG. 4 is an enlarged sectional view of an inner stacking ring of the container main body and showing a portion of a seal member sealingly attached over the top opening of the container body.

As best seen in FIG. 4, the container body sidewall 24 includes a short upper thick wall section 32 and a lower thinner wall section 34 therebelow. By way of example and not limitation, the preferred thickness for the thick wall section 32 can be approximately 0.020 inch (0.508 mm) and the preferred thickness of the thinner wall section 34 can be approximately 0.016 inch (0.406 mm). The thickness of the rim 18 at the bottom of the wall section 34 is approximately 0.023 inch (0.584 mm). To achieve the different wall thicknesses for the sections 32 and 34 and rim 18, the container herein is preferably injection molded.

Injection molding the present container portions 10 and 12 is advantageous over the prior thermoformed yogurt container portions in that thermoforming generally involves the stretching of a uniform thickness sheet of plastic that causes thin areas at some locations and a loss of strength at a location where more strength may be desired. In an injection-molded container, increased wall thickness may be added where desired to provide the desired strength. Further, thermoforming does not allow the control of a radius or the forming of sharp corners that can be achieved with injection molding; and these can lead to the telescoping together of containers during shipping or in certain drop tests. For example, as best seen in FIG. 3, the flange 18, to be sonically welded, is made thicker in cross-section than the cross-section of container sidewall 24. Also, a corner 19 joining the sidewall 24 to the flange 18 is made substantially thicker than the container wall or the flange to add mass to the corner in order to make it stronger. Thus, more plastic can be added selectively to the weldable flange 18 and to the corner 19 without adding to the mass of the rest of the container, as would be necessary in a thermoformed container. The thermoformed walls for these containers typically range between 0.010 inch (0.254 mm) and 0.016 inch (0.406 mm) thick. Also, because the injection-molded walls need not have a uniform thickness throughout, this allows different portions of the wall to be designed with various thicknesses and shapes such as the above-described container dewall 24 having thick and thinner sections 32 and 34, thereof.

Returning to FIG. 4, it can be seen that the thick wall section 32 stands substantially vertical or at a very slight incline relative to the lower thinner wall section 34 which tapers at more of an angle, e.g. 3.5° from vertical, down to the larger diameter bottom 28 of the sidewall 24. The preferred distance from the top 26 of the thick wall section 32 of the sidewall 24 down to the bottom 28 of the flange rim 18 is approximately 3.473 inches (8.821 cm). In addition, the thick wall section 32 steps down from the thinner wall section 34 at exterior shoulder 36 so as to have a smaller diameter relative to the progressively increasing top to bottom diameter of the wall section 34 with the distance from the shoulder 36 to the container body top 26 being short relative to the distance from the shoulder 36 down to the rim 18. The step of the shoulder 36 is approximately 0.015 inch (0.381 mm) so that the exterior surface 32*b* of wall section 32 is substantially axially aligned with interior surface 34*a* of wall section 34 at the top thereof. A radially inward projecting lip 38 is provided at the upper end of the wall section 32 and terminates radially distal from the wall section 32 around the container mouth opening 30.

In injection molding of the container upper body portion 10, forces occur during the stripping of the body portion from the mold as the core is pulled out that tend to form a crease in the sidewall 32 above the shoulder 36. To add strength to the sidewall 32, to resist such creasing, a series of ribs 37 are formed on the outside surface of the container extending upwardly, as viewed in FIG. 4, from the shoulder 36. The ribs 37 add more mass and strength. The preferred ribs have a 4:1 slope with the ribs being four times as high as wide in the radial direction.

For the preferred yogurt container by way of example and not limitation, the exterior diameter of the vertical thick wall section 32 is approximately 2.061 inches (5.235 cm); and the exterior diameter of the tapered thin wall section 34 at its smallest diameter top portion adjacent transition region 33 is approximately 2.094 inches (5.319 cm) with the interior diameter being approximately 2.064 inches (5.243 cm), and at its largest diameter at the bottom 28, it has an interior diameter of approximately 2.475 inches (6.287 cm). The outer diameter of the radial rim 18 is approximately 2.64 inches (6.706 cm). The annular lip 38 can extend radially from the top 26 of thick wall section 32 for approximately 0.165 inch (4.191 mm) so that the mouth 30 has a diameter of approximately 1.725 inch (4.382 cm). The distance from the shoulder 36 to the top 26 of the thick wall section 32 is approximately 0.310 inch (7.874 mm), and the distance down from the shoulder 36 to the top of the rim 18 is approximately 3.140 inches (7.976 cm) so that the total height of the container body 10 in the preferred 6 oz. (170 g) yogurt container embodiment is approximately 3.473 inches (8.821 cm), as previously mentioned. As is apparent, because of the location of the shoulder 36 at the transition region 33 high up along the sidewall 24 so that there is a relatively short upper thick wall section 32, there remains a much longer distance for the smooth wall section 34 so as to provide the food container herein with a large, uninterrupted surface area on its exterior sidewall surface 22 for receiving printing thereon. It has been found that in the preferred 6 oz. (170 g) yogurt container, the wall section 34 provides for approximately 2.87 inches (7.29 cm) of printing height which is about 10% greater than that afforded with the prior thermoformed and spinwelded container. The median printable circumference around the wall section 34 is 7.17 inches (18.21 cm), and less a 3/16 inch (4.76 mm) vertical gap, the printable circumference is 6.99 inches (17.48 cm).

The foil seal member 14 is adhered over the container top 26 so as to seal the mouth 30 and extends on the upper surface 38*a* of the lip 38 around the substantially right angle corner 40 formed between the lip 38 and wall section 32 and down towards the shoulder 36 on the exterior surface of the wall section 32 stopping at end 14*a* thereof. As the foil seal member 14 stops short of the exterior shoulder 36, a gripping space 41 is provided around the bottom of the wall section 32 between the seal member bottom end 14*a* and the exterior shoulder 36. Thus, to open the container by removal of the foil seal member 14, a person can insert their finger into the gripping space 41 for engaging the seal member end 14*a* with their fingers and peeling it from the exterior of the upper wall section 32 and lip 38 to remove the seal member 14 from across the container mouth 30 for accessing the food product e.g. yogurt, in the container interior 16.

For stacking of container bodies 10, the container sidewall 24 has an interior stacking shoulder or ring 42 formed integrally thereon and projecting radially into the container interior 16 substantially radially aligned with the exterior shoulder 36 so that the stacking ring 42 is provided at the transition region 33 of the sidewall 24 relatively close to the top 26 of the container body 10 between the container wall sections 32 and 34. As best seen in FIGS. 4 and 13, the bottom surface 42*a* of the stacking ring 42 is spaced below the top surface of the shoulder 36 preferably by approximately 0.020 inch (0.508 mm). The container bodies 10 are stacked with the top lip 38 of the lower container body 10*b* abutting the flat bottom surface 42*a* of the stacking ring 42 of the upper container body 10*a* as shown in FIG. 13. The distance of the nest interval $D_1$ (FIG. 5) between rims 18 of adjacent container bodies 10*a* and 10*b* will be substantially equal to the short distance between the top of the lip 38 and the ring bottom surface 42*a* which in the preferred form with the dimensions of the container body 10 as set forth earlier where the container is used as a yogurt container with the container interior filled with 6 oz. (170 g) of yogurt, gives a nest interval $D_1$ of 0.330 inch (8.382 mm) that is substantially less than the interval provided with the prior spinwelded yogurt container utilizing the lugs as the stacking structure. With the small nest interval $D_1$ of 0.330 inch (8.382 mm), there will be a small air gap of approximately 0.004 inch (0.102 mm) between adjacent wall sections 34 of container bodies 10*a* and 10*b* in the stack. Thus, the present container bodies 10 can be stacked in a much more compact, vertical arrangement providing for substantial savings in transportation costs in that a much greater number of container bodies 10 can be stacked in a prescribed space. This allows, for instance, a greater number of stacked container bodies 10 to be put into a carton box for shipping.

As mentioned, the container body 10 and base 12 are preferably both integral injection-molded pieces. Injection molding allows these plastic parts to be formed with more intricate shapes and walls and allows more control over the shape and cross-sectional thicknesses of the plastic so as to enhance the performance and durability of these plastic parts such as when subject to drop testing. In this regard, the transition region 33 between the thick wall section 32 and the thin wall section 34 has a fairly intricate shape with sharp angled corners on the exterior flat shoulder 36 and the inner stacking ring 42. For example, as can be seen in FIG. 4, the stacking ring surface 42*a* intersects with an inclined surface 44 at sharply angled corner 46 radially distal from the slightly radiused right angle juncture of the surface 42*a* with the inner surface 34*a* of the wall section 34.

In the preferred 6 oz. (170 g) yogurt container, the corner 46 is radially spaced from the inner wall surface 34*a* a short distance of 0.034 inch (0.8636 mm) so as not to unduly interfere with scooping of food from the container interior 16 while still providing for secure and stable stacking, as more fully discussed herein. The angled inclined surface 44 extends upwardly and radially outward from the corner 46 to the interior surface 32*a* of the wall section 32. As this transitional region 33 is thicker from between the corners of the shoulder 36 and ring 42 relative to wall sections 32 and 34, it also adds strength to the container wall 24. The intricate shape of the wall including the transition area 33 between the wall sections and the sharp corners and flat surfaces thereof are readily produced by injection molding whereas thermoforming a container having these types of sharply angled surface features would be much more difficult, if not impossible.

Additionally, the container body 10 is molded with an inner circumferential bead 48 which is used to strip the container body from the mold. The bead 48 is raised from the wall section inner surface 32*a* and is integral therewith, and likewise the bead 50 is raised from the wall section inner surface 34*a* and is integral therewith. Preferably the bead 48 is spaced down from the bottom of the lip 38 to its radial inwardmost point by a distance 0.100 inch (2.54 mm) with the radial spacing of this inwardmost point from the wall section interior surface 32*a* being approximately 0.005 inch (0.127 mm).

The stacking ring 42 extends continuously around the inner circumference at the transition area 33 of the sidewall 24 so as to present an unbroken flat surface 42*a* to be engaged with the flat top surface of the top lip 38 for stacking in a secure and stable manner. The continuous stacking ring surface 42*a* is molded flat to be abutted with a corresponding flat surface on the top of the lip 38 of an adjacent stacked container. Such an arrangement in the stack presents less of a risk of slippage of the engaged surfaces off from each other, especially when considered in conjunction with the thicker, stronger reinforced wall 24 of the container body 10. This is particularly important when the container bodies 10 are loaded in the stack as wedging and jamming of the stacked container portions can prevent separation by the mechanical devices of automatic feeding equipment with which the container portions 10 and 12 are to be utilized. Thus, the stacking structure including the ring surface 42 and the lip 38 of the present container body 10 is effective to maintain a constant and small uniform gap or nest interval $D_1$ between stacked container bodies 10 while keeping them stacked in a secure and stable manner.

Figure 9:
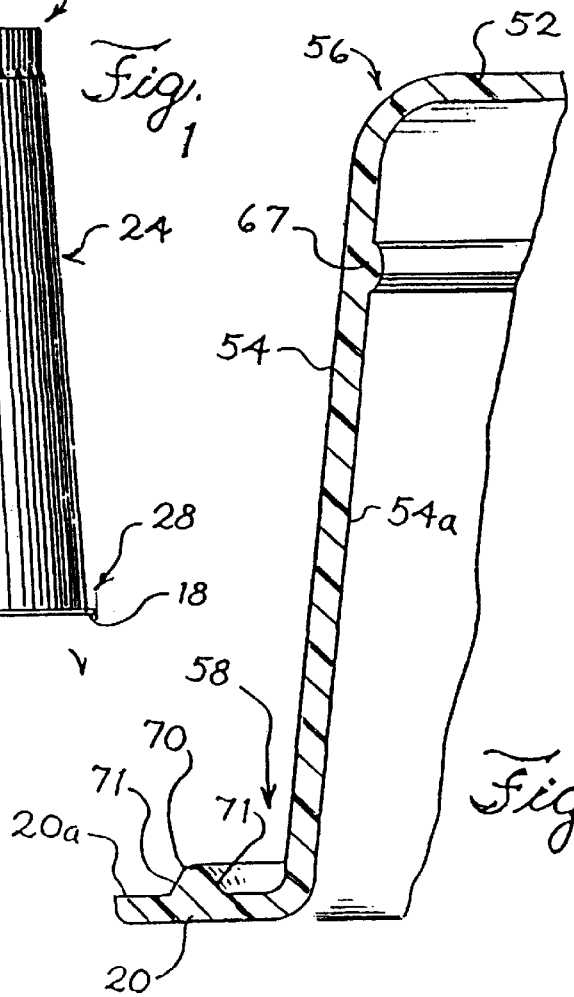
FIG. 9 is an enlarged sectional view of the frustoconical sidewall of the container base portion and showing an annular rim projecting radially outward from the bottom of the wall and including an energy director area of the rim for ultrasonically attaching the rims of the container body and base portions together.

Similar to the container body 10, the container base 12 is an injection-molded part so that it can be formed with a more intricate shape including having integral walls with different thicknesses. Referring to FIGS. 7 and 9, the container base includes an upper panel wall 52 and a frustoconical sidewall 54 which depends from the periphery of the panel wall 52 at the top 56 of the wall down to its bottom 58 at which annular rim 20 is formed. Similar to rim 18, the rim 20 projects radially outward from the wall bottom 58. The panel wall 52 is preferably slightly thicker in cross-sectional thickness than both the frustoconical sidewall 54 and the annular rim 20, with annular rim 20, in turn, being slightly thicker than the frustoconical sidewall 54.

For example, in the preferred form as a yogurt container, the container base 12 has a base panel 52 with a thickness of 0.018 inch (0.457 mm), a frustoconical sidewall 54 with a thickness of 0.016 inch (0.406 mm) and an annular rim 20 with a thickness of 0.016 inch (0.406 mm). The sidewall 54 tapers at about 7.5° from the vertical and has a vertical height from top 56 to the bottom of the rim 20 of approximately 0.500 inch (1.27 cm). The diameter across the panel wall 52 is preferably approximately 2.334 inches (5.928 cm) with the diameter across the outer edges of the rim 20 being larger, preferably on the order of 2.640 inch (6.706 cm). As discussed earlier, the base panel wall 52 has a relatively large diameter in comparison to the height of the sidewall 54 so that the panel 52 is more easily deflected when subject to loads due to the large span across the top 56 of the sidewall 54. By injection molding the panel wall 52 so that it is thicker than the sidewall 54, the panel wall 52 is provided with enhanced rigidity so as to be better able to withstand drop tests. To assist in withstanding drop tests and preventing any cracking of the walls 52 and 54 of the base member 12, a raised dome 60 is integrally formed at the center of the panel wall 52, as best seen in FIG. 8. The dome 60 has an arcuate inclined surface 62 relative to the flat panel wall 52 so that any loads on the center of the panel 52 will be substantially distributed thereabout so as to avoid stressing the panel center with direct loads thereon. The dome 60 adds strength and improved load bearing capacity such as when filled containers are subjected to drop tests. Instead of flexing the center of the panel wall 52, the loading created by the food product in the dropped containers will be distributed over the panel.

The dome 60 is preferably provided with a wall having different thicknesses with annular inclined portion 64 being thicker than the panel wall 52 and the top enlarged portion 66 being thicker than the annular portion 64. So, for example, with the preferred panel thickness of 0.018 inch (0.457 mm), the annular wall portion 64 will have a thickness of approximately 0.022 inch (0.559 mm) and the enlarged top portion 66 will have a thickness of approximately 0.032 inch (0.813 mm) at its thickest point at the center of the base 12. By providing the central top portion 66 as the thickest portion of the dome 60, the dome 60 itself is stiffened against flexing at its highest central point over the base panel wall 52 so as to improve its load distributing characteristics. Also, similar to body wall 24 having bead 48, base sidewall 54 includes an integral raised bead 67 (FIG. 9) formed on the wall surface 54*a* to aid in pulling the container base 12 from the mold. At its radially inwardmost point, the bead 67 is preferably spaced approximately 0.093 inch (2.362 mm) down from the bottom surface 52*a* of panel wall 52 and radially inward approximately 0.005 inch (0.127 mm) from wall surface 54*a*.

For stacking purposes, the container base wall 52 has integral circumferentially spaced stacking ribs 68 that are adjacent the top 56 of the sidewall 54 so as to minimize the 35 nest interval $D_2$ when the container bases 12*a* and 12*b* are stacked, as shown in FIG. 12. The ribs 68 are integrally formed at the junction of the panel wall horizontal surface 52*a* and frustoconical wall inclined surface 54*a* and project down from the horizontal surface 52*a* of the panel wall 52 a short distance so that when the upper horizontal surface 52*b* of the panel wall 52 of the lower base 12*b* engages with the generally flat bottom surface 68*a* of the ribs 68 of the upper base 12*a*, the nest interval $D_2$ between the container bases 12 is minimized. More specifically, the nest interval $D_2$ between the stacked bases 12 will be approximately equal to the distance from the bottom surface 68*a* of the stacking ribs 68 to the horizontal upper surface 52*b* of the panel wall 52. With the preferred panel wall thickness of 0.018 inch (0.457 mm) between lower and upper wall surfaces 52*a* and 52*b*, the preferred distance between the stacking rib bottom surface 68*a* and the panel wall lower horizontal surface 52*a* is approximately 0.182 inch (4.623 mm) so as to provide a 0.200 inch (5.08 mm) nest interval $D_2$ between adjacent stacked container bases 12. The stacking interval $D_2$ is significantly less than the stacking interval of the corresponding container bases in the prior yogurt container so that the container bases 12 herein can be stacked in a more compact, vertical arrangement providing advantages similar to the container body 10 in terms of a number of container bases 12 that can be shipped in a given amount of space such as in a box carton. Because of the small nest interval $D_2$, the stacked bases 12*a* and 12*b* have a small air gap of approximately 0.0058 (0.1473 mm) inch between adjacent base sidewalls 54.

An additional advantageous characteristic of the stacking ribs 68 over the prior lugs is that the ribs 68 project inwardly relative to the base walls 52 and 54 without the corresponding indentation formed in the walls exterior surfaces as with the thermoformed lugs. Accordingly, the ribs 68 provide a support and stiffening function as they gusset the walls 52 and 54 relative to each other so as to enhance the strength at the top juncture 56 between the base panel 52 and the frustoconical sidewall 54. In this manner, the stacking ribs 68 serve to stiffen the container base walls 52 and 54 so as to improve their performance when subjected to drop tests, as previously described. In the preferred yogurt container form, the ribs 68 project approximately 0.075 inch (1.905 mm) radially inward along the horizontal wall surface 52*a* from the frustoconical wall surface 54*a*, and as previously mentioned, project downwardly along the inclined wall surface 54*a* approximately 0.182 inch (4.623 mm) from the panel lower horizontal surface 52*a*. The ribs 68 can have sides 68*b* and 68*c* provided with a slight draft, such as 1° from the vertical, to converge towards the rib bottom surface 68*a* with a thickness between sides 68*b* and 68*c* being approximately 0.020 inch (0.508 mm).

Figures 14, 15:
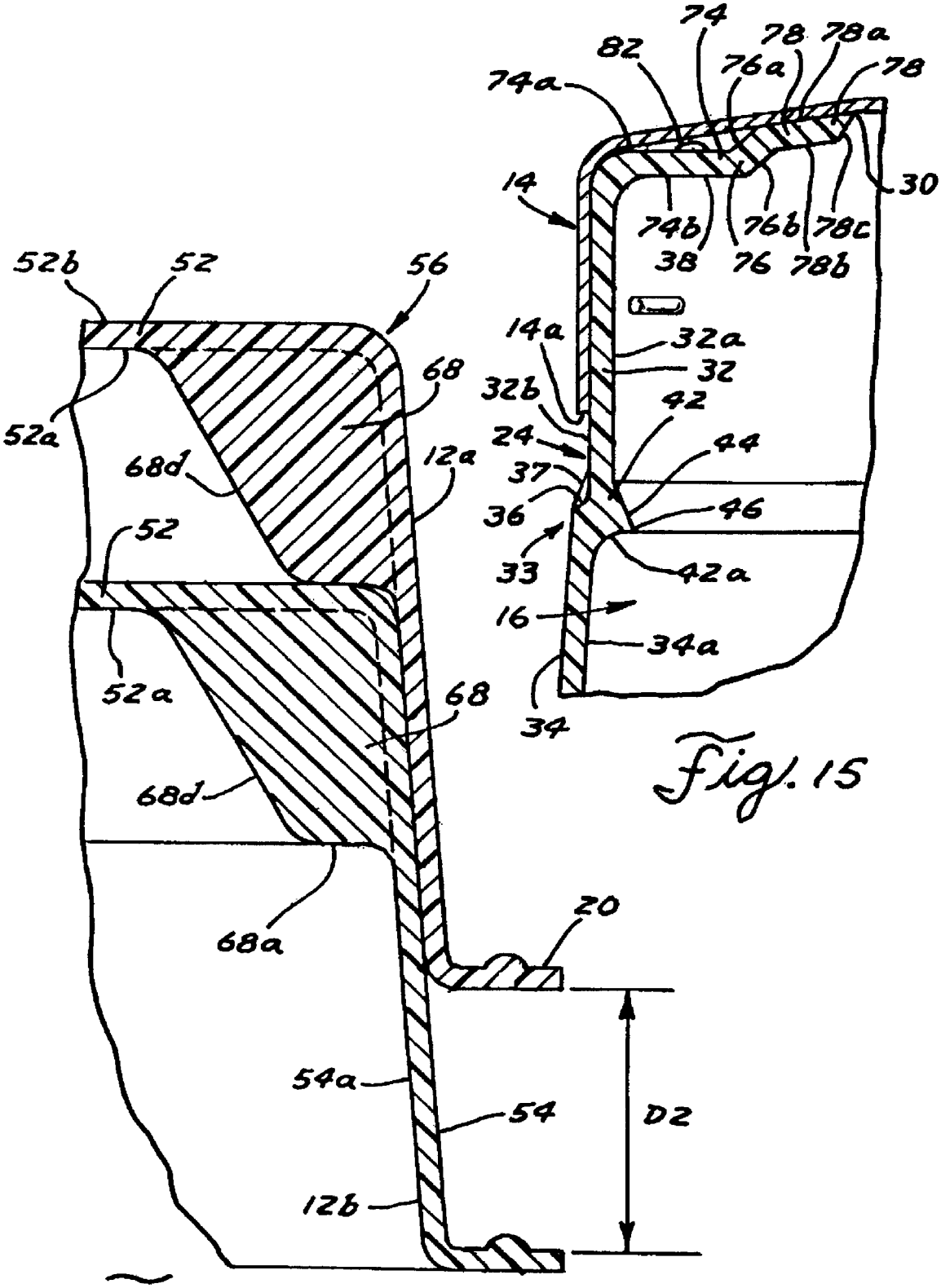
FIG. 14 is a fragmentary, sectional view showing an alternate form of two container base portions stacked one on top of the other in a compact, vertical arrangement.
FIG. 15 is a fragmentary, enlarged, sectional view showing an alternate form of the radially inward projecting lip of the container main body and showing a portion of a seal member sealing attached over the top opening of the container body.

In an alternate preferred yogurt container form as shown in FIG. 14, the ribs 68 can have inner edges 68*d* which taper outwardly in a downward direction to facilate self-aligning of the stacked container bases 12. In particular, the spacing of the interconnection of the edge 68*d* with the horizontal surface 52*a* from the wall surface 54*a* is considerably greater than the spacing of the interconnection of the edge 68*d* with the rib bottom surface 68*a* from the wall surface 54*a* and in the most preferred form is generally double the spacing of the interconnection of the edge 68*d* with the rib bottom surface 68*a* from the wall surface 54*a*. Specifically, the spacing of the interconnection of the edge 68*d* with the horizontal surface 52*a* from the wall surface 54*a* is generally equal to the distance the ribs 68 project downwardly along the inclined wall surface 54*a*, namely approximately 0.182 inch (4.623 mm) whereas the spacing of the interconnection of the edge 68*d* with the rib bottom surface 68*a* from the wall surface 54*a* is approximately 0.075 inch (1.905 mm). In the most preferred form, the edge 68*d* is linearly straight between its interconnection with the surfaces 52*a* and 68*a* (with the interconnections being radiused in the preferred form) and extends at an angle of approximately 550 from rib bottom surface 68*a*, with the surfaces 52*a* and 68*a* being generally parallel.

When two or more container bases 12 are properly stacked, as illustrated in FIGS. 12 and 14, the container bases 12 are centered with respect to one another, and the requisite spacing between the rims 20 of the container bases 12 is maintained around the entire peripheries of the rims 20. However, due to vibrations and handling associated with automated packaging equipment, two container bases 12*a* and 12*b* may try to become slightly off-center with respect to one another. In particular, the upper container base 12*a* could cant relative to the lower container base 12*b*. As an example referring to FIG. 12, the upper container base 12*a* could be positioned such that on the right side the rims 20 generally abut and the interconnection between the panel wall 52 and the sidewall 54 of the lower container base 12*b* abuts with the inner edge of the rib 68 of the upper container base 12*a*, while on the left side, the rims 20 are spaced generally equal to or slightly less than the height of the sidewall 54 of the lower container base 12*b* and the interconnection between the panel wall 52 and the sidewall 54 of the lower container base 12*b* abuts with the inclined surface 54*a* adjacent to the rim 20 of the upper container base 12*a*. This canting of the container bases 12*a* and 12*b* may prevent mechanical fingers of automated feeding equipment from moving between the rims 20 of adjacent container bases 12 but also may result in wedging of the container bases 12 together so that realignment may be difficult, requiring individual, manual separation and replacement.

Figure 16:
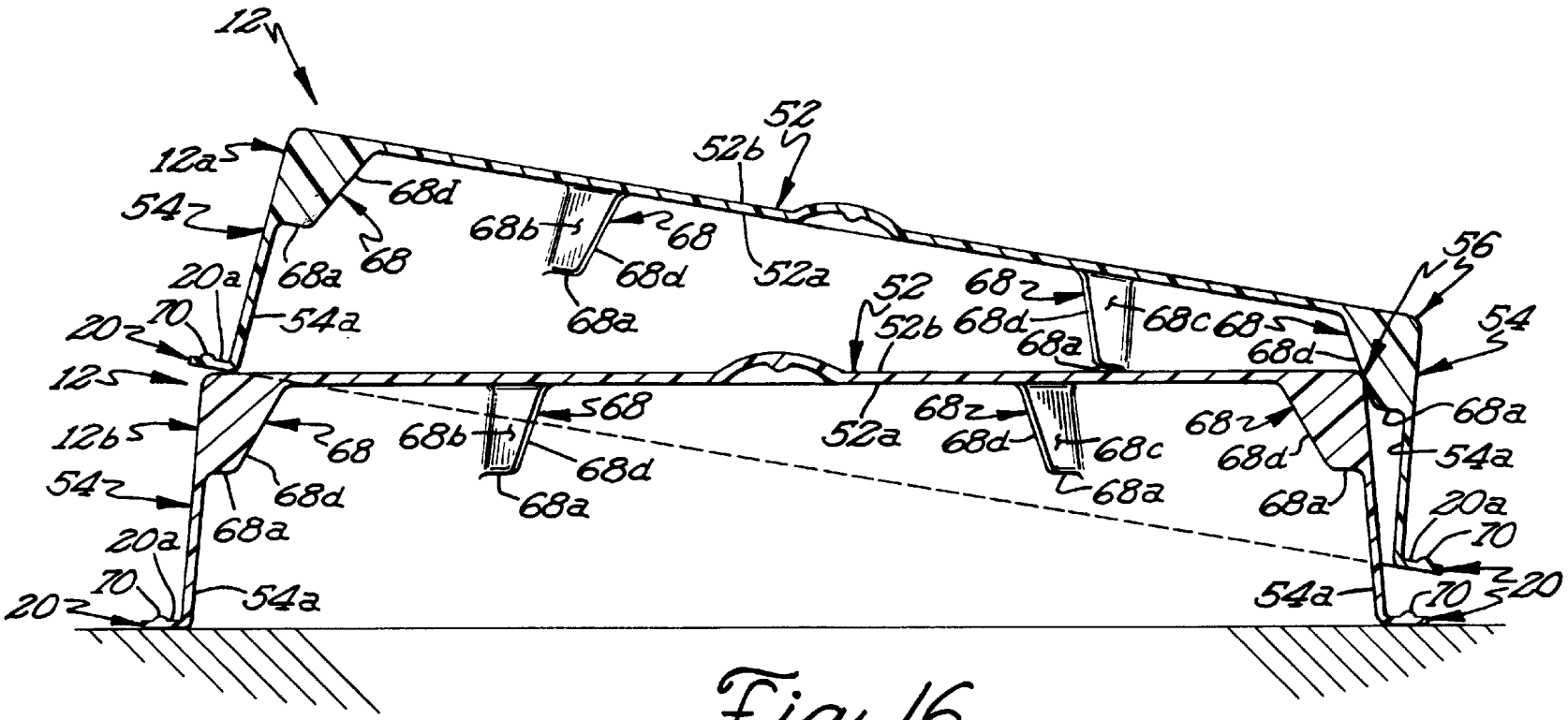
FIG. 16 is a sectional view showing two container bases portions stacked one on top of the other in a canted arrangement.

The ribs 68 of FIG. 14 are advantageous in preventing the tendency of the container bases 12 from moving off center. Particularly, the edges 68*d* act as camming surfaces to move the container bases 12 to be self-centered and to have equal peripheral spacing between the rims 20. In particular, with the edges 68*d* being angled from a vertical orientation, there are force components urging the upper container base 12*a* back to a centered position relative to the lower container base 12*b*, which would not exist for the ribs 68 of FIGS. 6, 7, 11, and 12 having generally vertical inner edges. In the event that it is noticed that some of the container bases 12 are canted within a stack of container bases 12 as shown in FIG. 16, the operator can run a hand along the edge of the stack which should raise and lower the container bases 12 relative to one another and the container bases 12 should self center.

To ultrasonically attach the container base 12 to the body 10, the respective annular rims 18 and 20 are welded to form welded plastic areas between the rims for connecting the base 12 to the body 10. More specifically, the rim 18 of the container body 10 has a lower surface 18*a* that is provided with a roughened irregular texture to facilitate ultrasonic bonding to the container base flange 20. In this regard, the container base rim 20 is provided with an upstanding annular energy director 70 projecting from its upper surface 20*a*, preferably approximately 0.015 inch (0.381 mm) high, and having a rounded top triangular cross-sectional shape, as best seen in FIG. 9. Accordingly, when a single container body 10 and a container base 12 are removed from their respective stacks such as by the mechanical devices of the processing equipment in engagement with the rims 18 and 20 and brought together in the ultrasonic fixture, the annular rims 18 and 20, and more particularly the textured bottom surface 18*a* and the energy director 70 will be brought into high frequency vibration with one another with the energy concentrated at the rounded top of the energy director 70. The molded texture surface 18*a* increases the abutting surface area between it and the raised energy director 70 so as to increase the frictional heat generated between the vibrating surfaces improving the melt of the energy director areas and bond quality between the rims 18 and 20. The preferred energy director adds more mass of plastic to the flange 20 and has a 0.010 inch (0.254 mm) radius on its top with sloping walls 71 (FIG. 9) defining a 60° angle therebetween and a height of 0.015 inch (0.381 mm). Once the container base 12 is ultrasonically welded to the container body 10, the automatic feeding equipment can take the welded container by the attached rims 18 and 20 to a filling station for being filled with food products and then on to a sealing station where the foil seal member 14 is adhered over the open mouth 30 of the filled container.

As previously mentioned, the container herein allows the mechanical devices of automated feeding equipment to be readily implemented with the radially projecting welded rims 18 and 20. Also, as previously discussed, the ultrasonic attachment of the container portions 10 and 12 eliminates the spinwelding process used to attach the prior yogurt container portions so that the present container, and of particular importance, the main body portion 10 thereof, no longer need include relatively large indented lugs that are provided towards the top of the container. In this manner, substantially the entire extent of the container body exterior surface 22 can be utilized to receive print thereon maximizing the surface area of the container body 10 used for this purpose. The container body 10 and base 12 herein are substantial improvements in terms of their strength for withstanding the drop tests to which they are subjected and for their processing in that they are readily adapted for use with currently employed automated container feeding equipment. Moreover, both the container body 10 and base 12 are provided with stacking structure so that their stack intervals between adjacent stacked pieces is reduced so that more parts can be stacked in a given space, and so that the stacking can occur in a more secure and stable manner. Even with the small nest intervals $D_1$ and $D_2$ of the respective container body 10 and base 12 herein, the rims 18 and 20 allow the mechanical devices of the processing equipment to readily separate the parts in a trouble free fashion from the stack.

In an alternate preferred yogurt container form as illustrated in FIG. 15, the radially inward projecting lip 38 is shaped to facilitate sealing with the seal member 14. In particular, the lip 38 includes a first, outer annular portion 74 having parallel, planar, upper and lower faces 74*a* and 74*b* which are generally horizontal and generally perpendicular to wall section 32 and surfaces 32*a* and 32*b*. The first portion 74 integrally terminates in a second, intermediate annular portion 76 having parallel, planar, upper and lower faces 76*a* and 76*b*. The upper and lower faces 76*a* and 76*b* extend at an obtuse angle of approximately 120° to upper and lower faces 74*a* and 74*b*, respectively. The second portion 76 integrally terminates in a third, inner annular portion 78 having parallel, planar, upper and lower faces 78*a* and 78*b*. The upper and lower faces 78*a* and 78*b* extend at a small acute angle of approximately 70 to the upper and lower faces 74*a* and 74*b*. The third portion 78 terminates in a free edge 78*c* which extends from an apex of the upper face 78*a* towards wall section 32 at an obtuse angle approximately equal to the obtuse angle between upper and lower faces 76*a* and 76*b* to upper and lower faces 74*a* and 74*b* and specifically approximately 120° to the upper and lower faces 74*a* and 74*b*, with the face 78*a* and the edge 78*c* forming a wedge shape. In particular, the lip 38 does not include a section extending from the third portion defining a generally vertical surface concentric to the second portion 76 and specifically an inwardly sloping frustoconical surface. The free edge 78*c* is parallel to and radially spaced inward of faces 76*a* and 76*b* in the preferred form.

The thicknesses of the first portion 74 between faces 74*a* and 74*b*, of the second portion 76 between faces 76*a* and 76*b* and of the third portion 78 between faces 78*a* and 78*b* are equal, are slightly greater than the thickness of wall section 32 between surfaces 32*a* and 32*b* and, in the most preferred form, are approximately 0.025 inches (0.635 mm). The length of the upper face 78*a* between edge 78*c* and upper face 76*a* is approximately 0.060 inches (1.524 mm). The length of the upper face 76*a* between upper faces 74*a* and 78*a* is less than the thickness of the portions 74, 76, and 78 and in the preferred form is approximately 0.010 inch (0.254 mm). The vertical spacing perpendicular to the upper face 74*a* between the upper face 74*a* and the interconnection between the upper face 78*a* and the free edge 78*c* is generally equal to the thickness of the portions 74, 76, and 78 and is approximately 0.025 inches (0.635 mm). The interconnections between surface 32*b* and face 74*a*, faces 74*a* and 76*a*, surface 32*a* and face 74*b*, faces 74*b* and 76*b*, faces 76*b* and 78*b*, and face 78*b* and edge 78*c* can be radiused.

The face 74*a* of the lip 38 is molded flat to be abutted with the unbroken flat surface 42*a* of an adjacent stacked container body 10. Thus, although not entirely flat as the lip 38 of FIGS. 4 and 13, the lip 38 of FIG. 15 allows the bodies 10 to be stacked in a secure and stable manner and also obtains the other advantages of the present invention. In the preferred form where the container body 10 is injection molded, gate area imperfections 82 can be created on the face 74*a* after the removal of the sprue in the molding process, with the gate area imperfections 82 located intermediate the face 76*a* and the radially outward portion of the face 74*a*.

The thin seal member 14 is adhered to the radially outward portion of face 74*a* and the face 78*a*, and in the preferred form, the portion of the thin seal member 14 radially beyond the face 74*a* is not sealed but simply pressed tightly against the exterior surface 32*b*. The stepping down of the thick wall section 32 from the thinner wall section 34 provides a recess for receipt of the peripheral portions of the seal member 14 to prevent unintentional catching of the peripheral edge bottom end 14*a* of the seal member 14 which may result in accidental partial removal or unsealing of the seal member 14 from the lip 38. It should be specifically noted that the exterior surface 32*b* is of a smooth, cylindrical shape in the preferred form and that an outwardly projecting roll rim or shoulder is not required around which the seal member 14 is crimped to grip the seal member 14 on the top of the body portion 10. In particular, the sealed container of the preferred form of the present invention is advantageous as providing a cleaner appearance as the seal member 14 also has a cylindrical appearance on the exterior surface 32*b* and has less of a tendency for the peripheral edge bottom end 14*a* to flare outwardly as can occur when the seal member 14 is crimped over a convoluted surface. Additionally, the sealing operation and specifically the mechanism of the processing equipment is simplified when the seal member 14 is pressed flat against the exterior surface 32*b* which is cylindrical compared to if the seal member 14 were crimped against an exterior surface of a convoluted shape.

The lip 38 of FIG. 15 is arranged so that the seal member 14 will tend to extend between the face 78*a* and the radially outward portion of face 74*a* without abutment with the face 76*a* and the radially inward portion of face 74*a*. In particular, the seal member 14 is sealed on the lip 38 in a manner to extend or bridge over the gate area imperfections 82 on face 74*a*. If the seal member 14 were forced down on the gate area imperfections 82 during the sealing of the seal member 14 on the lip 38, the gate area imperfections 82 can undesirable puncture the seal member 14. The height differential provided by the portion 76 intermediate the portions 74 and 78 creates a void between the seal member 14 and the lip 38 so that the seal member 14 spans over the gate area imperfections 82. This span effect is also enhanced by the upward angling of the portion 78 relative to the first portion 74 and the horizontal, with the upward angling of the portion 78 also enhancing the area of sealing between the seal member 14 and the face 78*a*.

The preferred shape of lip 38 of FIG. 15 according to the teachings of the present invention is believed to insure that sealing occurs between the seal member 14 and the lip 38 around the entire periphery of the lip 38. This in turn allows the portion of the seal member 14 not to be sealed with the exterior surface 32*b* so that the consumer can readily separate the peripheral bottom end 14*a* of the seal member 14 from the wall section 32 for ease of grasping and pulling to completely remove the seal member 14 from the main body portion 10 when it is desired to consume the yogurt or other food product contained in the interior 16 of the container. Adhering the seal member 14 to its bottom end 14*a* upon the body portion 10 may make separating the peripheral bottom end 14*a* from the container difficult when it is desired to remove the seal member 14 from the container. Also, the enhanced sealing provided by the shaping of the lip 38 according to the teachings of the present invention contributes to the ability to eliminate the requirement of gripping of the seal member 14 on an outwardly projecting roll rim or shoulder over which the seal member 14 must be crimped to provide sealing attachment.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. A lower container portion for closing off a bottom of a plastic container having a hollow interior for receiving food products therein, with the lower container portion comprising, in combination: a base wall having an upper horizontal surface adapted for supporting the food products when in the container interior, a lower horizontal surface, and an outer periphery; a frustoconical sidewall depending downwardly from a junction at the outer periphery of the base wall at a smaller diameter top down to a larger diameter bottom thereof; a plurality of circumferentially spaced stacking ribs interconnecting the base wall and the frustonconical sidewall while projecting inwardly relative to the frustoconical sidewall below the base wall which allow the lower container portions to be stacked one on top of the other in a compact vertical arrangement, with each of the stacking ribs having an inner edge which tapers outwardly in a downward direction; and an annular flange projecting radially outward from the bottom of the frustoconical sidewall at a distance from the base wall which permits stacked lower container portions to cant relative to each other, the annular flange having welding areas disposed therearound adapted for ultrasonic attachment with other container portions, with the flange capable of cooperating with high speed automatic container feeding equipment wherein, if stacked lower container portions cant relative to each other, the inner edges of the stacking ribs can be caused to cam with the junction of other lower container portions for self-centering the stacked lower container portions.

2. The lower container portion in accordance with claim 1 wherein the inner edges are linearly straight.

3. The lower container portion in accordance with claim 2 wherein the stacking ribs are integrally formed with the base wall to provide support and stiffening to the junction between the frustoconical sidewall and the base wall.

4. The lower container portion in accordance with claim 3 wherein each of the stacking ribs include a bottom surface spaced a distance from and generally parallel to the base wall, with the inner edge interconnected to the bottom surface spaced from the frustoconical sidewall, with the bottom surface engaging with the upper horizontal surface of the base wall when the lower container portions are stacked one on top of the other in the compact vertical arrangement; and wherein the inner edge adjacent the base wall is spaced from the frustoconical sidewall approximately the same as the distance of the bottom surface from the base wall.

5. The lower container portion in accordance with claim 4 wherein the distance of the bottom surface from the base wall is less than the distance between the base wall and the bottom of the frustoconical sidewall.

6. The lower container portion in accordance with claim 5 wherein each of the stacking ribs are integrally formed with the frustoconical sidewall, with the frustoconical sidewall being free of indentations corresponding to the stacking ribs.

7. The lower container portion in accordance with claim 6 wherein each of the stacking ribs have first and second sides provided with a slight draft to converge towards the bottom surface.

8. An upper container portion for a plastic container having a hollow interior for receiving food products therein, with the upper container portion comprising, in combination: a sidewall having a top; a lip projecting radially inward from the top of the sidewall to define an opening of the upper container portion, with the lip including an outer annular portion extending from the sidewall, with the outer annular portion having an outer face, with the lip further including an inner annular portion radially inward of the outer annular portion, with the inner annular portion having an outer face and terminating in a free edge, with the outer face of the inner annular portion extending upwardly at a small acute angle to the outer face of the outer annular portion and terminating in an apex, with the free edge extending from the apex towards the sidewall at an obtuse angle relative to the outer face of the outer annular portion, with the free edge and the outer face of the inner annular portion forming a wedge shape having an interconnection between the free edge and the outer face of the inner annular portion, the structure of the lip and the relationship between the inner and outer annular portions being such that when a flexible seal member is installed over the opening and the lip the flexible seal member will be substantially linear from the apex to the top of the side wall.

9. The upper container portion in accordance with claim 8 wherein the lip further includes an intermediate annular portion having an outer face, with the inner annular portion terminating in the intermediate annular portion, with the outer face of the inner annular portion being planar and extending upwardly from the intermediate annular portion to the free edge, with the intermediate annular portion terminating in the outer annular portion, with the outer face of the intermediate annular portion extending upwardly at an obtuse angle relative to the outer face of the outer annular portion.

10. The upper container portion in accordance with claim 9 wherein the obtuse angle of the intermediate annular portion is approximately equal to the obtuse angle of the free edge of the inner annular portion.

11. The upper container portion in accordance with claim 10 wherein the obtuse angle is approximately 120°.

12. The upper container portion in accordance with claim 11 wherein the acute angle is approximately 7°.

13. The upper container portion in accordance with claim 9 wherein the outer annular portion has a thickness; and wherein the interconnection is spaced generally perpendicular to the outer face of the outer annular portion a distance approximately equal to the thickness of the outer annular portion.

14. The upper container portion in accordance with claim 13 wherein each of the inner and intermediate annular portions have a thickness generally equal to the thickness of the outer annular portion.

15. The upper container portion in accordance with claim 14 wherein the sidewall includes an upper wall section terminating in a lower wall section, with the upper wall section having the top, with the upper wall section stepping down from the lower wall section.

16. The upper container portion in accordance with claim 15 wherein the thickness of the outer annular portion is greater than the thickness of the upper wall section, with the thickness of the upper wall section being greater than the thickness of the lower wall section.

17. The upper container portion in accordance with claim 16 wherein the lower wall section is frustoconical in shape and tapers outwardly from the upper wall section.

18. The upper container portion in accordance with claim 17 wherein the lower wall section includes an interior surface and a stacking ring projecting radially inward from the interior surface of the lower wall section allowing upper component portions to be stacked one on top of the other in a compact vertical arrangement.

19. The upper container portion in accordance with claim 18 wherein the lower wall section includes a bottom and an annular flange projecting radially outward from the bottom of the corner wall section, with the annular flange having welding areas therearound disposed for ultrasonic attachment, with the annular flange adapted to cooperate with high speed automatic container feeding equipment.

20. The upper container portion in accordance with claim 8 wherein the outer annular portion has a thickness; and wherein the interconnection is spaced generally perpendicular to the outer face of the outer annular portion a distance approximately equal to the thickness of the outer annular portion.

* * * * *